US007938280B2

(12) United States Patent
Dunn

(10) Patent No.: US 7,938,280 B2
(45) Date of Patent: May 10, 2011

(54) HALF RACK

(75) Inventor: Wesley Owens Dunn, Mount Juliet, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 353 days.

(21) Appl. No.: 11/085,277

(22) Filed: Mar. 21, 2005

(65) Prior Publication Data

US 2005/0218096 A1 Oct. 6, 2005

Related U.S. Application Data

(60) Provisional application No. 60/558,274, filed on Mar. 31, 2004.

(51) Int. Cl.

| | |
|---|---|
| ***A47F 5/08*** | (2006.01) |
| ***F24C 15/16*** | (2006.01) |
| ***C10C 3/12*** | (2006.01) |
| ***E01C 19/45*** | (2006.01) |
| ***F24H 1/00*** | (2006.01) |

(52) U.S. Cl. ..... 211/153; 126/337 R

(58) Field of Classification Search ..... 211/153, 211/126.9, 181.1, 182, 85.3, 106, 187, 126.8, 211/103; 126/332, 337 A, 337 R, 339; 403/326, 403/329; D7/409, 332, 339, 348

See application file for complete search history.

(56) References Cited

U.S. PATENT DOCUMENTS

| | | | | |
|---|---|---|---|---|
| 1,404,632 | A * | 1/1922 | Morgan | 220/529 |
| 1,997,432 | A | 4/1935 | Replogle | |
| 2,272,524 | A * | 2/1942 | Johnson | 68/237 |
| 2,352,345 | A * | 6/1944 | Rundell | 211/153 |
| 2,671,004 | A * | 3/1954 | Chadwick et al. | 312/350 |
| 3,137,249 | A * | 6/1964 | Postula et al. | 108/27 |
| 3,435,958 | A * | 4/1969 | Chesley | 211/133.2 |
| 3,450,025 | A * | 6/1969 | Fleming | 99/399 |
| 4,733,987 | A * | 3/1988 | Tomlinson et al. | 403/326 |
| 6,067,981 | A | 5/2000 | Peter et al. | |
| 6,112,916 | A * | 9/2000 | Barnes et al. | 211/153 |
| 6,173,847 | B1 * | 1/2001 | Zellner et al. | 211/186 |
| 6,349,717 | B1 * | 2/2002 | Thompson et al. | 126/337 R |
| 2004/0112852 | A1 | 6/2004 | Brooks | |

OTHER PUBLICATIONS flat. Dictionary.com. Dictionary.com Unabridged. Random House, Inc. http://dictionary.reference.com/browse/flat (accessed: Jan. 15, 2010).* flattened. merriam-webster.com. Merriam-Webster Online Dictionary. http://www.merriam-webster.com/dictionary/flattened (accessed: Jan. 15, 2010.*

* cited by examiner

*Primary Examiner* — Katherine Mitchell

*Assistant Examiner* — Jeremy C Ramsey

(74) *Attorney, Agent, or Firm* — Pearne & Gordon LLP

(57) ABSTRACT

A half rack includes a main section having a primary platform area, a secondary platform area, a side support edge, and a cutout portion. The half rack further includes a removable section adapted to be removably secured to the main section, wherein a frame of the main section includes a rear crossbar, and an elongated stiffener is provided across a portion of the primary platform area and a portion of the secondary platform area and coupled to the rear crossbar to provide strength to the main section. The main section of the half rack can include flattened areas on first and second side edges of the main section.

11 Claims, 4 Drawing Sheets

HALF RACK

CROSS REFERENCE TO RELATED APPLICATIONS

This application claims the benefit of U.S. Provisional Patent Application No. 60/558,274, filed on Mar. 31, 2004, and entitled HALF RACK.

BACKGROUND OF THE INVENTION

1) Field of the Invention

The present invention relates to racks for appliances, and more particularly, to a half rack for an oven.

2) Description of Prior Art

Ovens often have one or more racks generally within the oven. The racks are useful for the placing of cookware, food, and other items, within the oven. The racks place the cookware generally towards the middle of the oven, and keep the cookware away from heating elements and the like. In addition, ovens with multiple racks allow for placement of cookware on a variety of levels within the oven, thereby increasing the total volume of available cooking space.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Oven racks are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a half rack for an appliance is provided. The rack includes a main section having a primary platform area, a secondary platform area, a side support edge, and a cutout portion; and a removable section adapted to be removably secured to the main section, wherein a frame of the main section includes a rear crossbar, and an elongated stiffener is provided across a portion of the primary platform area and a portion of the secondary platform area and coupled to the rear crossbar to provide strength to the main section.

In accordance with another aspect of the present invention, a half rack is provided which includes: a main section having a cutout portion; and a removable section adapted to be removably secured to the main section, wherein the frame of the main section includes a first side edge and a second side edge, and wherein each of the first and second side edges includes at least one flattened area therein.

In accordance with yet another aspect of the present invention, a main section having a cutout portion; and a removable section adapted to be removably secured to the main section, wherein the removable section includes a pair of hook shaped members adapted to engage a first wire member of the main section and a pair of u-shaped members adapted to engage second and third wire members of the main section, and wherein a bottom portion of the u-shaped members include an inward facing projection to provide a snap fit engagement with the second and third wire members thereby mitigating unintentional disengagement of the removable section from the main section.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
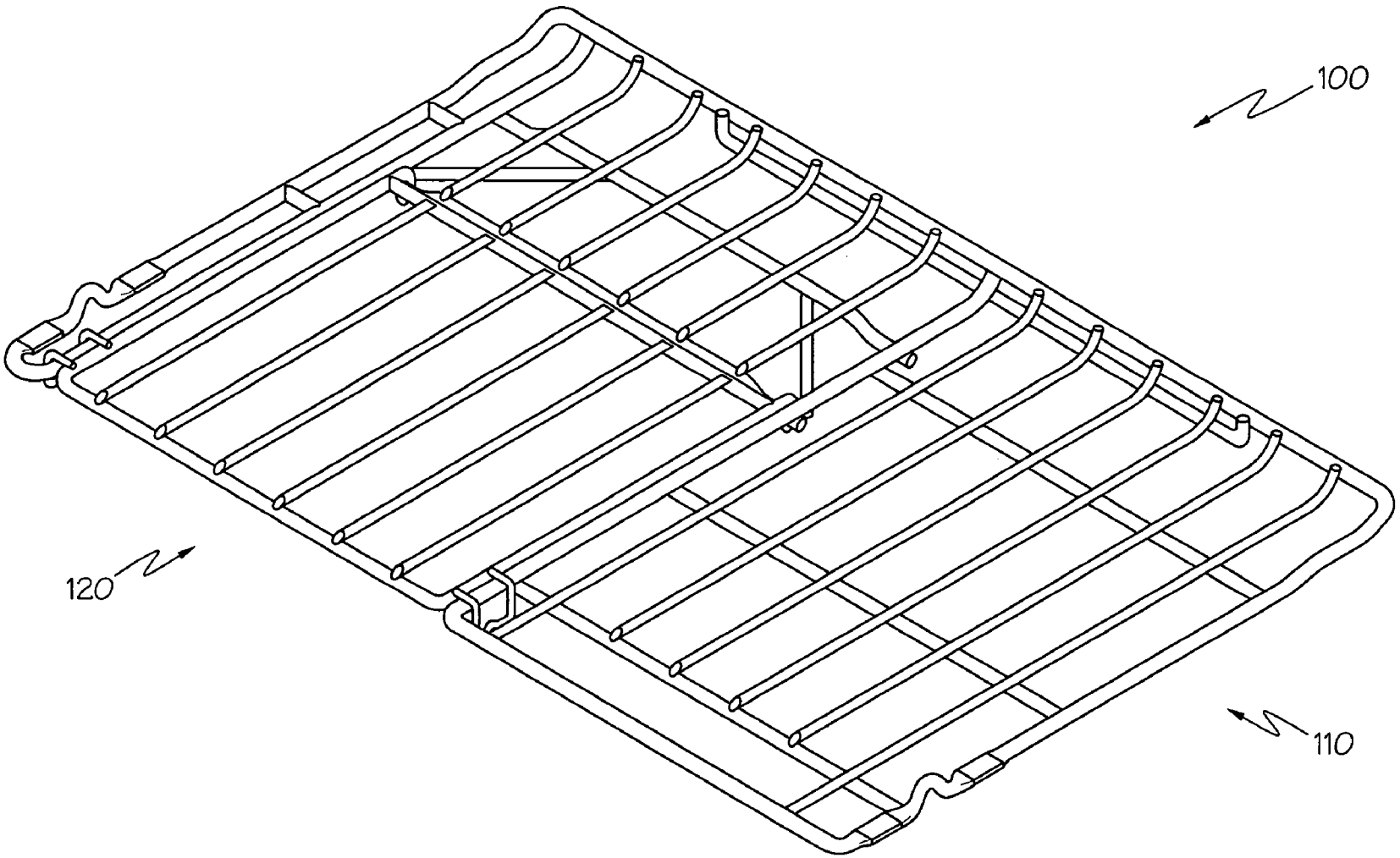
FIG. 1 illustrates a perspective view of an example of a half rack having a main section and a removable section in accordance with an aspect of the present invention.

The present invention relates to a half rack for an oven. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention may be practiced without these specific details.

Referring initially to FIG. 1, an example of a half rack 100 for an oven is illustrated in accordance with an aspect of the present invention. The half rack 100 includes a main section 110 and a removable section 120. Both the main section 110 and the removable section 120 can be constructed from metal wire, such as iron coated with nickel. However, it is to be appreciated that the main section 110 and the removable section 120 can be constructed from any suitable material (e.g., sheet metal). Moreover, it is to be appreciated that the main section 110 can be constructed from a first material and the removable section 120 can be constructed from a second different material. The removable section 120 is adapted to be removably secured to the main section 110. More specifically, the removable section 120 includes at least two connector legs, which will be discussed in further detail below, to engage corresponding portions of the main section 110.

Figure 2:
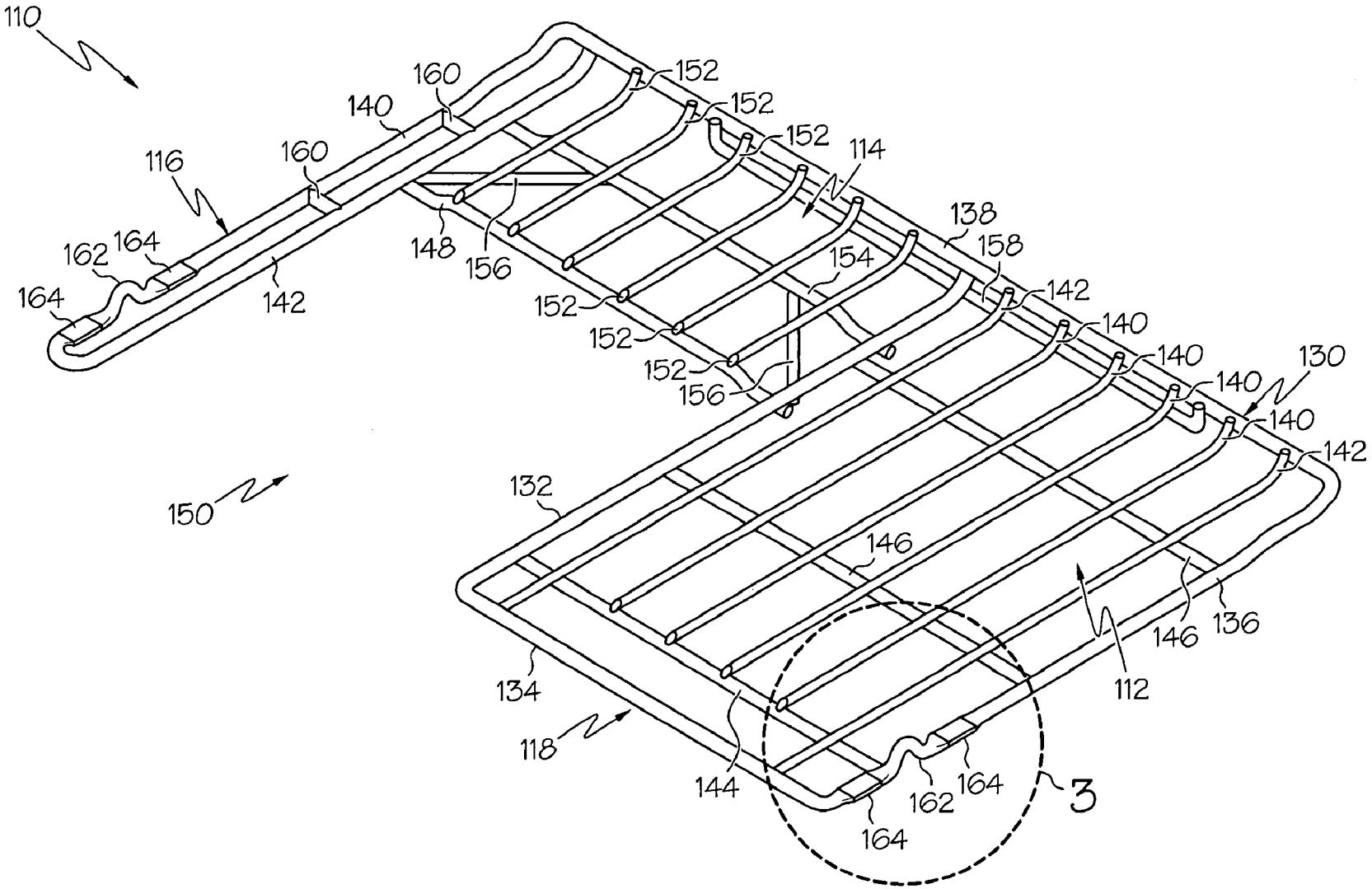
FIG. 2 illustrates a perspective view of the main section of the half rack of FIG. 1 in accordance with an aspect of the present invention.

Turning now to FIG. 2, the main section 110 of the half rack 100 is depicted in accordance with an aspect of the present invention. The main section 110 of the half rack 100 comprises a generally rectangular shape having a cutout portion 150 formed therein. In particular, the main section 110 includes a primary platform area 112, a secondary platform area 114, a side support edge 116, and a handle portion 118. The aforementioned areas of the main section 110 are partially defined by a first frame 130. The first frame 130 can comprise a continuous wire bent into shape to form a first cutout side bar 132, a front crossbar 134, a first side edge 136, a rear crossbar 138, a second side edge 140, and a second cutout side bar 142. The ends of the first and second cutout side bars 132 and 142 can be welded (e.g., spot welded), or otherwise secured, to the rear crossbar 138.

The primary platform area 112 is defined by the first cutout side bar 132, the front crossbar 134, the first side edge 136 and a portion of the rear crossbar 138. The primary platform area 112 includes a plurality of bars 140, 142, a handle cross-member 144, and one or more strengthening cross-members 146. The bars 140, 142 and cross-member(s) 144, 146 can be manufactured from metal wire or any other suitable material which provides adequate strength to support items such as cake pans, pizza stones and casseroles and withstands the heat of an oven.

The plurality of bars include one or more first bars 140 of a first length and one or more second bars 142 of a second length. In particular, the first bar(s) 140 has a length that extends between the rear crossbar 138 of the frame 130 and the handle cross-member 144 such that the first bar(s) 140 has a first end welded, or otherwise secured, to the rear crossbar 138 and a second end welded, or otherwise secured, to the handle cross-member 144. The first bar(s) 140 can also be welded, or otherwise secured, to the cross-member(s) 146 at corresponding mating points. The second bar(s) 142 has a length that extends between the rear crossbar 138 of the frame 130 and the front crossbar 134 of the frame 130 such that the second bar(s) 142 has a first end welded, or otherwise secured, to the rear crossbar 138 and a second end welded, or otherwise secured, to the front crossbar 134. The second bar(s) 142 can also be welded, or otherwise secured, to the handle cross-member 144 and strengthening cross-member (s) 146 at corresponding mating points. The second bar(s) 142 operates to mitigate sagging of the primary platform area 112 with respect to the front crossbar 134 when heavy food or cookware is placed on the primary platform area 112. Sagging of the primary platform area 112 presents problems with easily sliding the food or cookware from the primary platform area 112 without interference from the front crossbar 134.

The handle cross-member 144 is positioned at a distance rearwardly from the front crossbar 134 so as to create a handle portion that facilitates pulling out and/or removing of the main section 110 from an oven. The strengthening cross-member(s) 146 operates to provide additional strength to the primary platform area 112 of the main section 110. The handle cross-member 144 and the strengthening cross-member(s) 146 extend between the first cutout side bar 132 and the first side edge 136 and each of the cross-members 144, 146 have first and second ends which are respectively welded, or otherwise secured, to the first cutout side bar 132 and the first side edge 136.

The secondary platform area 114 is defined by a portion of the first cutout side bar 132, a portion of the rear crossbar 138, a portion of the second cutout side bar 142, and a cutout crossbar 148. The secondary platform area 114 includes a plurality of bars 152, one or more strengthening cross-members 154, and one or more diagonally extending stiffeners 156. As in the primary platform area 112, the cutout crossbar 148, plurality of bars 152, cross-member(s) 154, and stiffener (s) 156 of the secondary platform area 114 can be manufactured from metal wire or any other suitable material which provides adequate strength to support items such as cake pans, pizza stones and casseroles and withstands the heat of an oven.

The cutout crossbar 148 and the strengthening cross-member(s) 154 extend between the first and second cutout side bars 132, 142 such that each of the cutout crossbar 148 and the strengthening cross-member(s) 154 have first and second ends which are respectively welded, or otherwise secured, to the first and second cutout side bars 132, 142. The plurality of bars 152 are of substantially the same length and extend between the rear crossbar 138 of the frame 130 and the cutout crossbar 148 such that the bars 152 have a first end welded, or otherwise secured, to the rear crossbar 138 and a second end welded, or otherwise secured, to the cutout crossbar 148. The bars 152 can also be welded, or otherwise secured, to the cross-member(s) 154 at corresponding mating points. The diagonally extending stiffener(s) 156 of the present invention comprise two stiffeners, each extending between one of the first and second cutout side bars 132, 142 and the strengthening cross-member 154, such that first and second ends of the stiffeners 156 are welded, or otherwise secured, to the cutout side bars 132, 142 and strengthening cross-member 154, respectively. However, it is to be appreciated that one or more stiffeners can be positioned at any suitable location on the secondary platform to provide strength for the secondary platform and is contemplated as falling within the scope of the present invention.

Optionally, an elongated u-shaped stiffener 158 can be provided across a rear portion of the main section 110. In particular, the u-shaped stiffener 158 can extend across a portion of the primary platform area 112 and a portion of the secondary platform area 114 and coupled to the rear crossbar 138 to provide strength to the main section 110.

The side support edge 116 of the main section 110 is defined by the second cutout side bar 142, the second side edge 140 and a small portion of the rear crossbar 138. The side support edge 116 is provided to facilitate support of the main section 110 within a rack position of an oven and to facilitate coupling of the removable section 120 with the main section 110. The side support edge 116 can include one or more strengthening cross-members 160 for strength. The cross-member(s) 160 can be manufactured from metal wire or any other suitable material that can withstand the heat of an oven.

Figure 5:
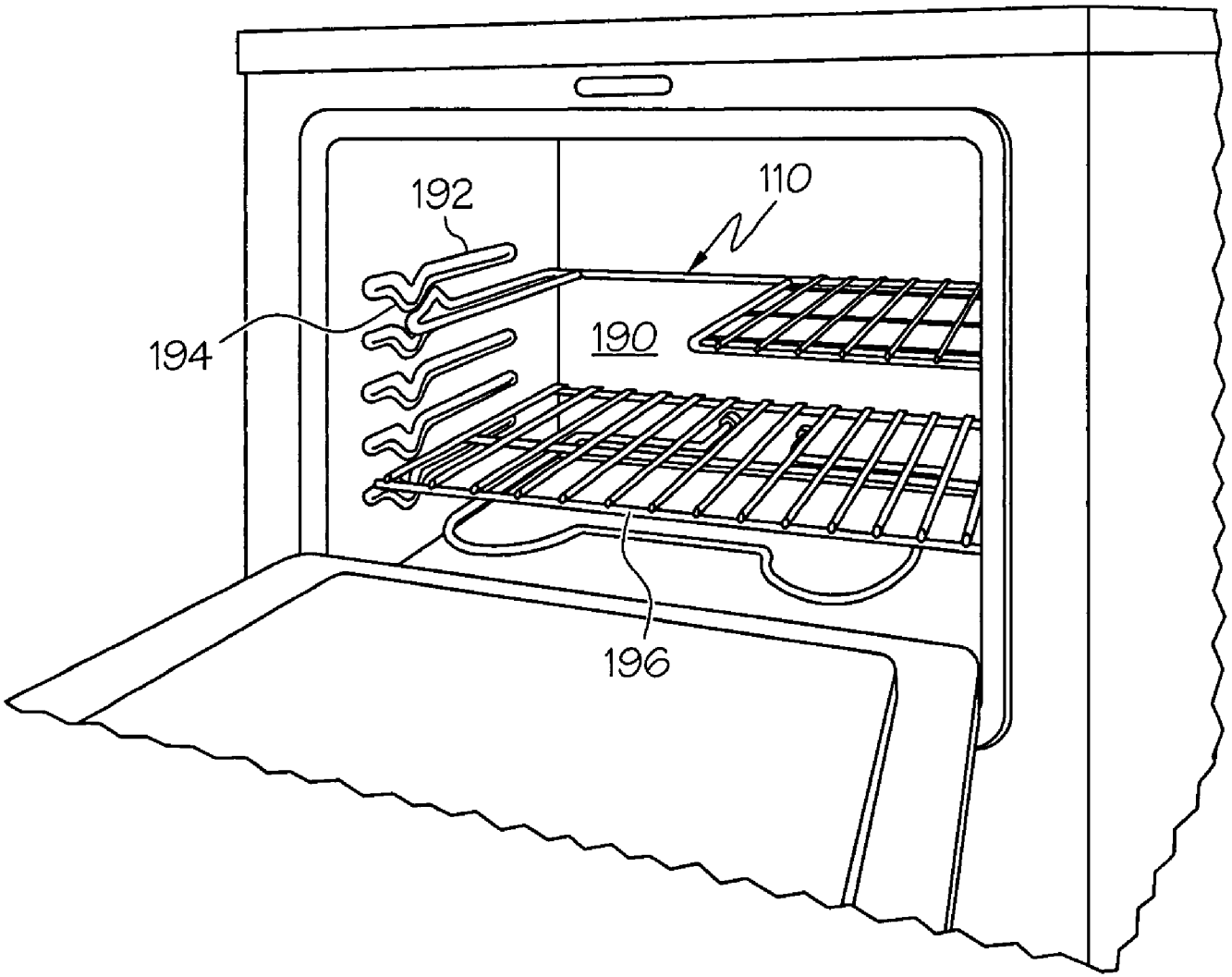
FIG. 5 illustrates a perspective view of the half rack in an oven environment in accordance with an aspect of the present invention.

The first and second side edges 136, 140 each have an upward-facing projection 162 integrally formed in the wire frame of the main section 110 to facilitate alignment of the rack within an oven. Referring briefly to FIG. 5, a standard rack location in an oven environment 190 includes a top guide rail 192 having a downward-facing projection 194. Specifically, the upward-facing projection 162 of the main section 110 is adapted to contact the downward-facing projection 194 of the top guide rail 192 such that a stop is created to properly align the main section 110 within the standard rack location of the oven.

Figure 3:
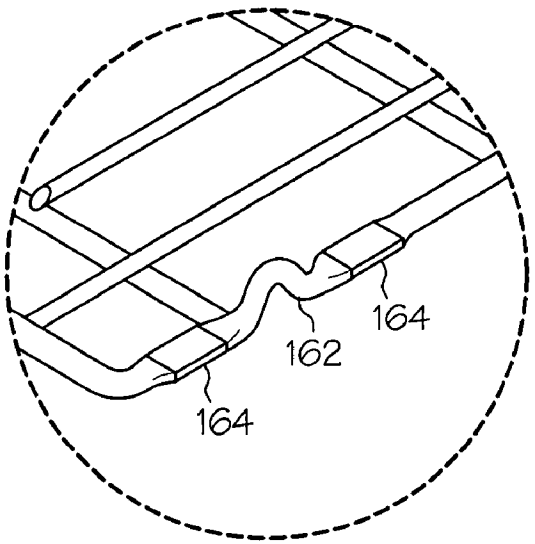
FIG. 3 illustrates a perspective view of an increased contact area for the main section of FIG. 2 in accordance with an aspect of the present invention.

Turning back to FIG. 2, each of the first and second side edges 136, 140 include one or more, preferably two, flattened areas 164 in accordance with an aspect of the present invention. The flattened areas 164 are positioned at a front portion of the first and second side edges 136, 140 and more specifically, one flattened area 164 is provided on either side of the upward-facing projections 162. FIG. 3 illustrates the flattened areas 164 in further detail. The flattened areas 164 allow the upward-facing projections 162 to be positioned outwardly, past a centerline of the first and second side edges 136, 140 to facilitate greater engagement of the upward-facing projections 162 with the oven guide rails. Further, the flattened areas 164 facilitate improved positioning of the main section 110 within the oven as the flattened areas 164 provide greater contact areas between the first and second side edges 136, 140 and the oven guide rails. Thus, the stability of the main section 110 is improved when subjected to a load, such as a load placed on the main section 110 when detaching the removable section 120 from the main section 110.

Figure 4:
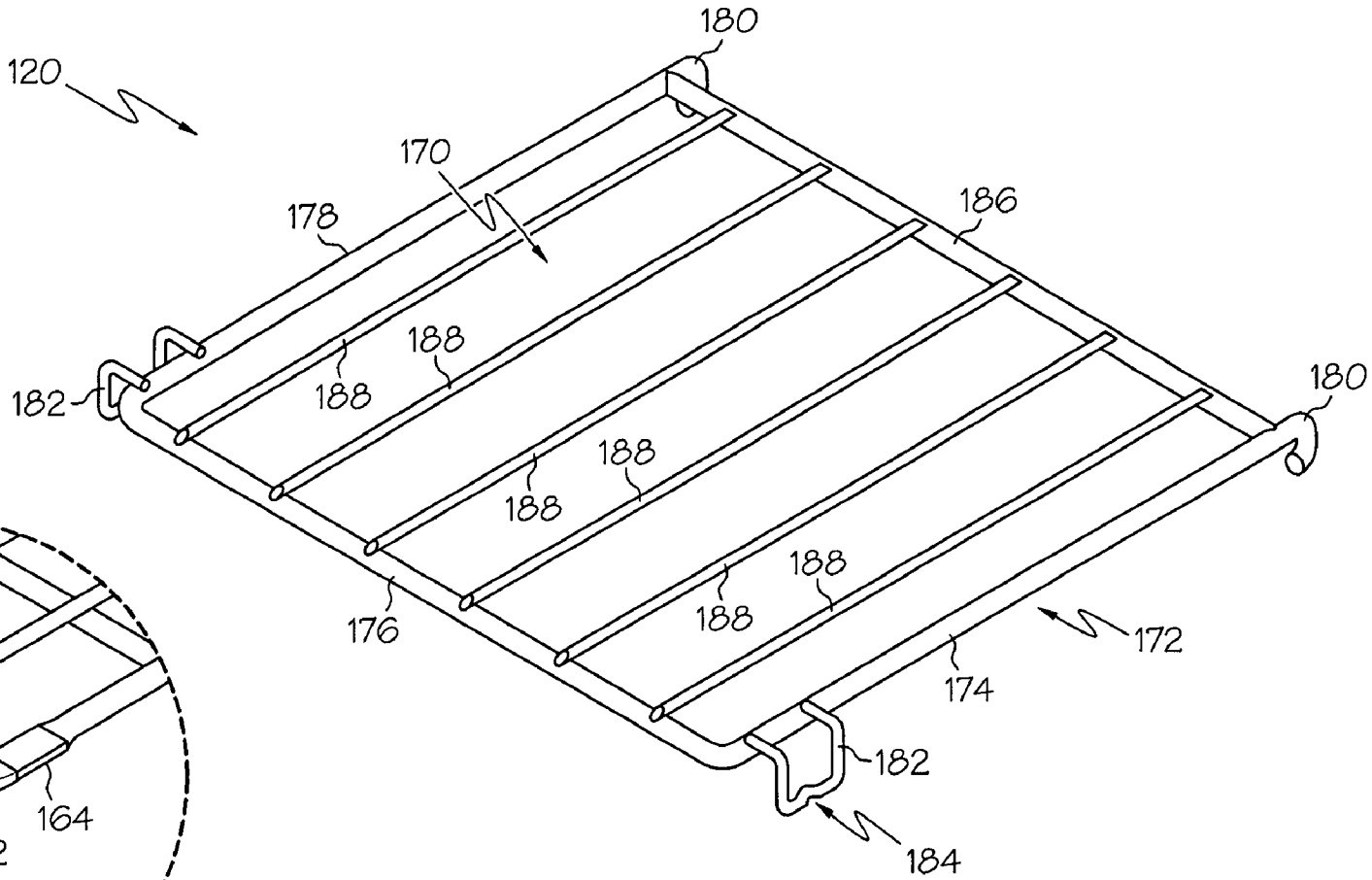
FIG. 4 illustrates a perspective view of the removable section of the half rack of FIG. 1 in accordance with an aspect of the present invention.

Turning now to FIG. 4, the removable section 120 of the half rack 100 is shown in accordance with an aspect of the present invention. The removable section 120 comprises a generally rectangular shape which defines a tertiary platform area 170 for the half rack 100. The tertiary platform area 170 is partially delineated by a second frame 172. The second frame 172 can comprise a continuous wire bent into shape to form a first side edge 174, a front crossbar 176, and a second side edge 178. The ends of the first and second side edges 174 and 178 can be bent into hook shaped members to form a first pair of connector legs 180. The first pair of connector legs 180 are adapted to hook onto the cutout crossbar 148 of the main section 110. A second pair of connector legs 182 are coupled to each of the first and second side edges 174, 178 via spot welding or the like. The second pair of connector legs 182 can be substantially u-shaped and formed from a continuous metal wire. Further, the second pair of connector legs 182 can project outwardly and downwardly from the first and second side edges 174, 178 so as to overlie and engage the first and second cutout side bars 132, 142 of the main section 110. A bottom portion of the u-shaped connector legs 182 can include an inward facing projection 184 to further provide a snap fit engagement between the connector legs and the first and second cutout side bars 132, 142. The snap fit engagement mitigates unintentional decoupling of the removable section from the main section. It is to be appreciated that any suitable number or configuration of connector legs can be coupled to or integrally formed within the removable section 120 to effectively couple the removable section 120 with the main section 110 of the half rack 100 and is contemplated as falling within the scope of the present invention. Additionally, or alternatively, the main section 110 can include connector members to facilitate coupling of the removable section 120 with the main section 110.

A rear crossbar 186 extends between the first and second side edges 174 and 178 and is welded, or otherwise secured, thereto. The tertiary platform area 170 also includes a plurality of bars 188 and optionally, one or more strengthening cross-members (not shown). The frame 172, rear crossbar 186, bars 188, and cross-member(s) can be manufactured from metal wire or any other suitable material which provides adequate strength to support items such as cake pans, pizza stones and casseroles and withstands the heat of an oven. The bars 188 are of the same length and extend between the rear crossbar 186 and the front crossbar 176 such that the bars 188 have a first end welded, or otherwise secured, to the rear crossbar 186 and a second end welded, or otherwise secured, to the front crossbar 176. The bars 188 can also be welded, or otherwise secured, to the cross-member(s), if present, at corresponding mating points.

The removable section 120 can also include a handle portion (not shown) similar in design to the handle portion 118 of the main section 110, if desired. The handle portion could extend the entire width of the removable section 120 such that when the removable section 120 and the main section 110 are employed together, at least a portion of at least one of the handles is always exposed.

When the removable section 120 is not combined with the main section 110, it can be stored or used as a cooling rack for supporting hot items or baked goods on a counter top. The connector legs 172, 178 of the removable section 120 can also be utilized as support legs to support the removable section 120 about a counter if the removable section 120 is employed as a cooling rack. Since the removable section 120 is relatively small and light, its removal from the main rack can be readily accomplished with little effort.

FIG. 5 depicts the main section 110 half rack 100 of the present invention employed within an oven environment 190. The removable section 120 has been detached from the main section 110 to create an open area in the rack 160. Thus, with the removable section 120 detached, a "taller" food can be cooked on a lower rack 196 of the oven without the need to remove the entire rack 100 from an upper position in the oven cavity 190, as the taller food can pass through the open area in the rack 100. Accordingly, the primary and second platform areas 112, 114 of the main section 110 can be utilized to support items for cooking such that a full capacity of the oven can be utilized. It is to be appreciated that the removable section 120 and the corresponding open area 150 in the main section 110 can be of any suitable size and shape.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the exemplified embodiment, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The handles on the rack of the subject invention can be made from the same material as the rack. For example, the handles can be fashioned from steel bars which are spot welded to the frame. Alternatively, the handles can be made of an insulated material to protect someone grasping the handle from burns. Suitable insulating materials include ceramics which can likewise be applied to the handle to provide insulation qualities.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A rack for an appliance comprising:

a main section having a cutout portion; and a removable section adapted to be removably secured to the main section, wherein the frame of the main section includes a first side edge, and a second side edge, and wherein each of the first and second side edges have a wire form, and wherein each of the first and second side edge wire forms includes at least two flattened areas and an upward facing projection positioned between the two flattened areas, wherein the at least two flattened areas have a non-circular cross sectional shape as taken along a section perpendicular to a longitudinal axis of the wire, and wherein each of the first and second side edge wire forms includes non-flattened areas having a substantially circular cross sectional shape as taken along a section perpendicular to the longitudinal axis of the wire.

2. The rack of claim 1, wherein the at least one flattened area located on each of the first and second side edges is positioned at a front portion of the first and second side edges.

3. The rack of claim 1, wherein the frame of the main section further includes a rear crossbar, a front crossbar, and first and second cutout side bars.

4. The rack of claim 3, further comprising an elongated u-shaped stiffener coupled to the rear crossbar.

5. The rack of claim 1, further comprising a handle cross-member disposed rearwardly of the front crossbar.

6. The rack of claim 5, further comprising a plurality of bars extending between the rear crossbar and the handle cross-member and at least one strengthening bar extending between the rear crossbar and the front crossbar.

7. The rack of claim 1, further comprising a cutout crossbar extending between the first and second cutout side bars.

8. The rack of claim 7, further comprising a plurality of bars extending between the rear crossbar and the cutout crossbar.

9. The rack of claim 1, further comprising at least one strengthening cross-member extending between the first and second cutout side bars.

10. The rack of claim 9, further comprising at least one diagonally extending stiffener extending between the at least one strengthening cross-member and one of the first and second cutout side bars.

11. The rack of claim 1, wherein the removable section includes a pair of hook shaped members adapted to engage a first wire member of the main section and a pair of u-shaped members adapted to engage second and third wire members of the main section, and wherein a bottom portion of the u-shaped members include an inward facing projection to provide a snap fit engagement with the second and third wire members thereby mitigating unintentional disengagement of the removable section from the main section.

* * * * *